US010494813B2

(12) United States Patent
Costanza

(10) Patent No.: US 10,494,813 B2
(45) Date of Patent: Dec. 3, 2019

(54) SYSTEM AND METHOD FOR AFFIXING INSULATED PANELS

(71) Applicant: KPS Global LLC, Fort Worth, TX (US)

(72) Inventor: James M. Costanza, Flower Mound, TX (US)

(73) Assignee: KPS GLOBAL LLC, Fort Worth, TX (US)

( * ) Notice: Subject to any disclaimer, the term of this patent is extended or adjusted under 35 U.S.C. 154(b) by 0 days.

(21) Appl. No.: 15/248,098

(22) Filed: Aug. 26, 2016

(65) Prior Publication Data

US 2018/0058748 A1 Mar. 1, 2018

(51) Int. Cl.
*E04B 2/00* (2006.01)
*E04C 2/38* (2006.01)
*F25D 13/00* (2006.01)

(52) U.S. Cl.
CPC ..... *E04C 2/38* (2013.01); *F25D 13/00* (2013.01); *F25D 2201/10* (2013.01)

(58) Field of Classification Search
CPC .... F25D 23/065; F25D 13/00; F25D 2201/10; E04B 1/80; E04C 2/284; E04C 2/38
USPC ..... 52/506.04, 461, 466, 468
See application file for complete search history.

(56) References Cited

U.S. PATENT DOCUMENTS 1,357,713 A * 11/1920 Lane ..... E04B 1/6803 404/69
3,381,436 A * 5/1968 Elliott ..... E04B 1/6803 52/309.13
3,570,205 A * 3/1971 Payne ..... E04B 1/6175 52/466
3,688,460 A * 9/1972 Van Loghem ..... E04F 19/065 277/641
4,067,155 A * 1/1978 Ruff ..... E04B 1/6803 4/498
5,365,713 A * 11/1994 Nicholas ..... E04B 1/681 52/396.03
5,611,185 A * 3/1997 Wilz ..... E04B 9/001 52/395
6,588,165 B1 * 7/2003 Wright ..... E04F 19/06 52/459
6,745,534 B2 * 6/2004 Kornfalt ..... E04F 15/04 52/395
8,291,665 B2 * 10/2012 Sondermann ..... E04F 19/061 52/459
8,966,847 B2 * 3/2015 Kessler ..... E04B 1/6804 52/395
9,631,372 B1 * 4/2017 Bilge ..... E04F 13/072
2007/0245662 A1 * 10/2007 Stanchfield ..... E04D 1/365 52/459

* cited by examiner

*Primary Examiner* — Basil S Katcheves
(74) *Attorney, Agent, or Firm* — Marshall, Gerstein & Borun LLP

(57) ABSTRACT

An insulated panel system includes a joint disposed between two insulated panels. The joint has a male portion and a female portion. The female portion has a flange, sidewalls, and a base that can be secured to an existing structure. The male portion includes a top plate with sealing sides that rest against the face of the insulated panel when inserted into the female portion. The sealing sides prevent warm air and/or moisture from ingress into a refrigerated space defined by the insulated panels. Also disclosed is a sealing joint for insulated structural panels.

17 Claims, 10 Drawing Sheets

SYSTEM AND METHOD FOR AFFIXING INSULATED PANELS

BACKGROUND OF THE INVENTION

1. Field of the Invention

The present invention relates generally to structural insulated panels for use in custom-design and prefabricated walk-in refrigerator and freezer spaces. More specifically, the present invention relates to an insulated veneer system for extending the life of existing pre-fabricated and custom designed walk-in refrigerator and freezer spaces.

2. Background of the Invention

Walk-in refrigerator and freezer spaces are typically manufactured and assembled using pre-fabricated insulated structural panels joined together to define the refrigerated space. The structural panels provide insulation to maintain the temperature inside the walk-in space using as little energy as possible. The most vulnerable areas of the insulated space or located at the joints of the structural panels. Because the air inside a refrigerated area is often at a lower pressure than the ambient air outside of the area, the resultant pressure gradient causes warm air to attempt ingress through the joints between the panels. This vulnerability inevitably leads to some amount of warm (and moist) air moving into the joints between panels. As the warm air cools to at or below the dew point as it moves closer to the enclosed refrigerated area, condensate may form in the joint, which in turn may freeze if the pressure gradient is such that the warm air moves quickly into the joint past the point at which freezing temperatures are found. In the case of walk-in freezer spaces, this condensation can freeze in the joint between structural insulated panels. The ice warmed by the frozen condensation can further expand the joint between the structural panels, causing an additional loss of thermal insulation, and additional ingress of relatively warm, moist air, which in turn may result in degradation of the overall efficacy of the refrigerated space. This degradation can result in a dramatic increase in the amount of energy required to maintain the refrigerated walk-in at a suitable temperature for storing perishable goods.

In addition to the problem with existing structural panel refrigeration systems noted above, over time the structural panels lose insulative properties around the edges of the structural members as a function of the type of structural and insulation materials used, inadvertent damage caused to the exterior surfaces of the structural panels, and the natural degradation of sealants used between the joints. Generally, the useful life of a structural panel refrigerated space is limited based on the factors listed above, and can reach an unacceptable level of insulation within a matter of 7 to 10 years from the original installation. Accordingly, it would be desirable to have a system that effectively extends the life of a pre-existing structural panel-based walk-in refrigerated space. It would also be desirable to have a system for sealing the joints of structural panel-based walk-in refrigerated spaces upon original construction/installation.

SUMMARY OF THE INVENTION

One embodiment of the invention includes a two-piece locking insert operable to secure insulated veneer panels to a pre-existing insulated structural panel wall structure. A female locking insert has a flange that overlaps the insulated veneer and is secured to the structural wall with a fastener, which may or may not be integral to the female portion. A male locking insert is inserted into the female portion such that it has flanges that overlap the female locking insert flanges and provide a seal against the face of the veneer panels. The veneer panels may be configured such that the seams of the veneers are located along the mid-line of the insulated structural panels to reduce the amount of refrigerated air from inside the insulated structural panels from coming into contact with outside ambient air. The flanges may be of a dual-density material whereby the edges of the male flanges are softer than the body of the male insert, thereby permitting a better seal between the male flange and the surface of the insulated veneer. Certain commercial embodiments of the invention have already been certified for use by NSF International in applications that involve the refrigeration of perishable goods.

Another embodiment includes an I-beam shaped seal that is inserted between standard structural panels. The I-beam shaped seal is inserted between standard insulated structural panels. The I-beam shaped seal includes a flange in accordance with the present invention that is shaped to create a seal between the flange and the exterior surface of the insulated structural wall. In this embodiment, the central portion includes openings, such as slits, slots, or gaps that allow for locking mechanisms to join adjacent panels together. When the lock is tightened, the panels compress the I-beam shaped seal between the panels to create an air-tight, or near air-tight seal to prevent loss of refrigerated air between the panels.

Other embodiments in accordance with the spirit and scope of the invention will become apparent to those of skill in the art.

DETAILED DESCRIPTION OF THE INVENTION

Figure 1A:
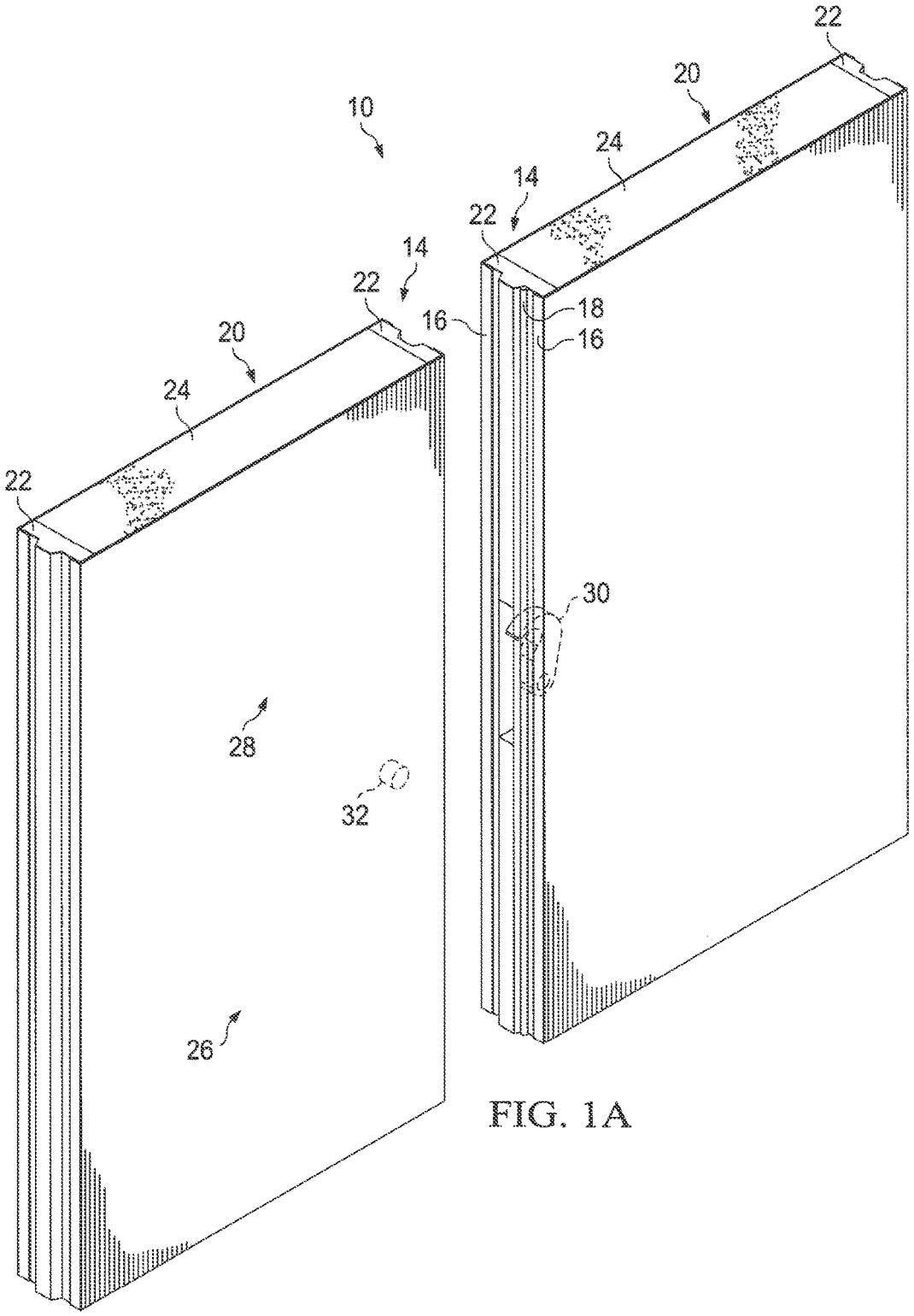
FIG. 1A shows traditional insulated structural panels in accordance with the prior art.
Figure 1B:
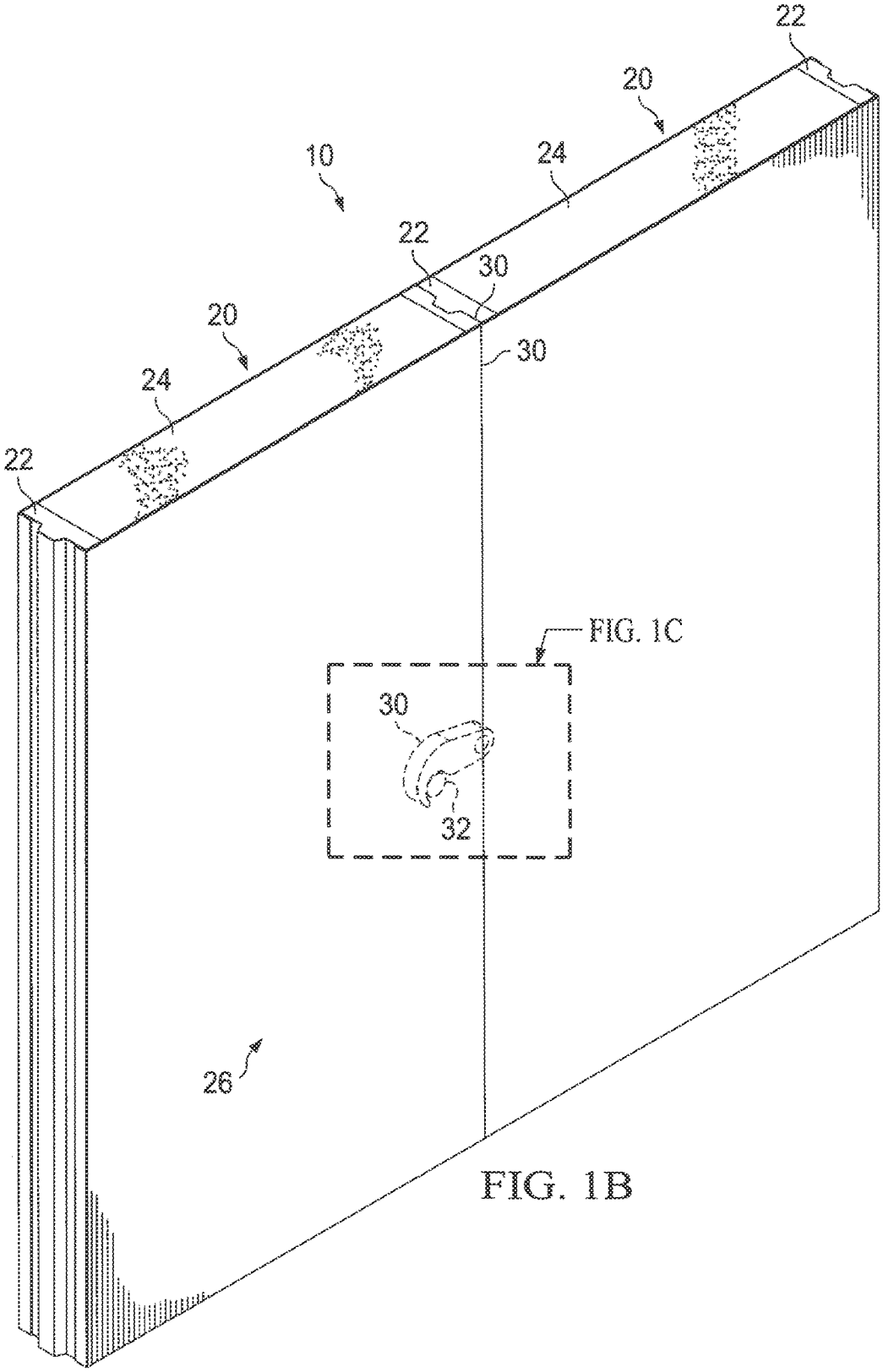
FIG. 1B shows traditional insulated structural panels joined together to form an insulated structural wall.

The present invention is directed to systems and methods of maintaining the insulative properties of insulated structural panels. FIGS. 1A and 1B generally show an insulated structural panel system that, when joined together, form a wall for a pre-defined or custom-built refrigerated space. In FIG. 1A, for example, two un-joined panels 20 are shown as part of an insulated structural wall 10. Each structural panel 20 is constructed of vertical structural members 22 and horizontal structural members 24. The structural members 22 and 24 may be constructed of wood, a composite, metal, or any other suitable structural material as would be understood by one of ordinary skill in the art. Structural panels 20 are typically constructed using sheathing 26, which it may be steel, aluminum, or other suitable sheathing material, which is hell into place while an insulating material, such as closed-cell polyurethane foam (not shown) is blown were injected between the sheathing 26.

Figure 1C:
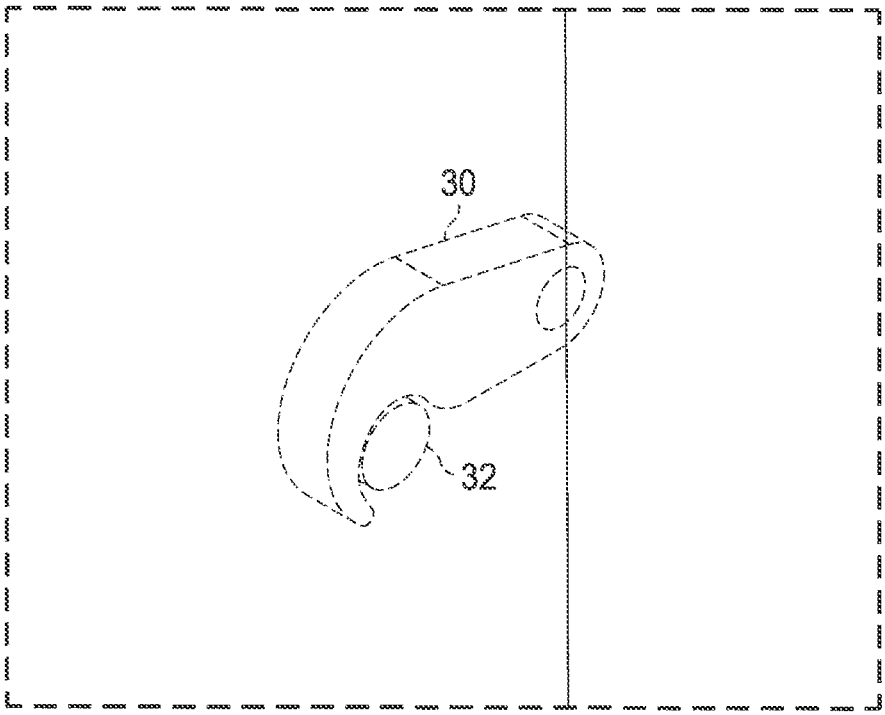
FIG. 1C shows a latch and latch bar mechanism used to joint together insulated structural panels.

The insulated structural panel is primarily assembled by virtue of the closed-cell polyurethane foam 28 acting as an adhesive to hold the sheathing and structural members in place. Insulated structural panels 20 or further typically design such that vertical structural members 22 include a tongue-in-groove design. A latch 30 and latch-bar 32, or other suitable connecting hardware is typically disposed within the panel to facilitate joining the panels together. When the latch 30 is actuated to engage the latch-bar 32, for example, the insulated structural panels are drawn tightly together, as shown in FIGS. 1B and 1C.

The width of the structural panel may be determined by the application for which the insulated structural panels are to be used. The insulated polyurethane structural panels have a typical thermal resistance ("R-value") of R-8 per inch. Typical insulated structural panels that are to 6 inches in width, accordingly have corresponding R-values of R-24 to R-48. The structural members 22 and 24, however, when constructed of wood, only have a total R-value of R-3 to R-6. Because of the poor insulative properties of structural panels manufactured with wood structural members 22, more warm air moves toward the lower-pressure refrigerated space predominantly at joint 30. Over time, as the relatively warm and moist outside air travels through the joint 30, condensation may form. In the case of an insulated structural panel system used for refrigeration, this condensation may remain in liquid form and become a source of potential mold or bacterial growth. In the case of insulated structural panel freezer systems, condensation formed a joint 30 can result in the formation of ice, which, when formed in, or within joint 30 can expand the joint. Expansion of this joint 30 further degrades the efficacy of the insulated structural panel system, especially at the joint 30.

Figure 2A:
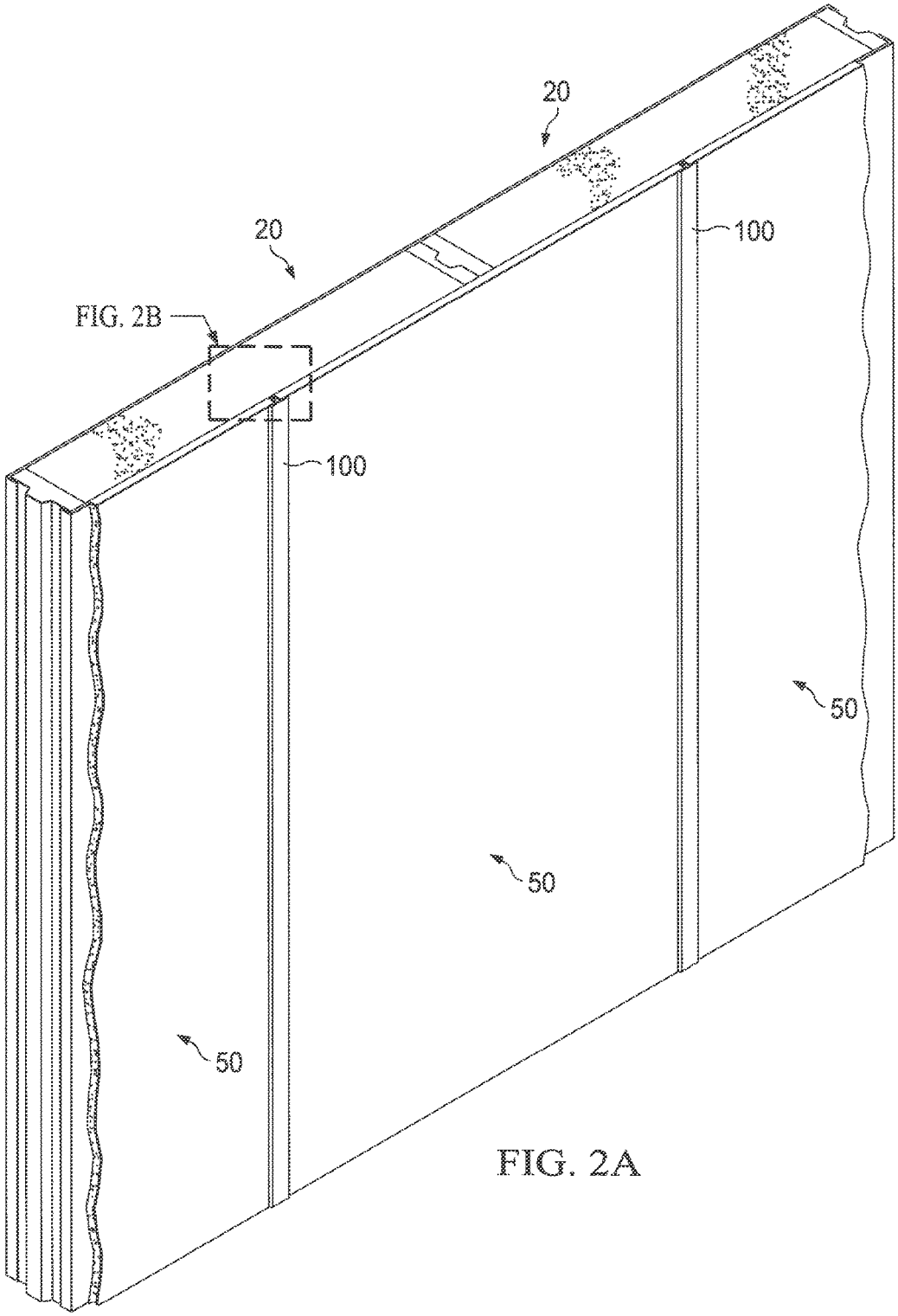
FIG. 2A shows an insulated veneer system installed on the exterior surface of a traditional insulated structural panel wall.
Figure 2B:
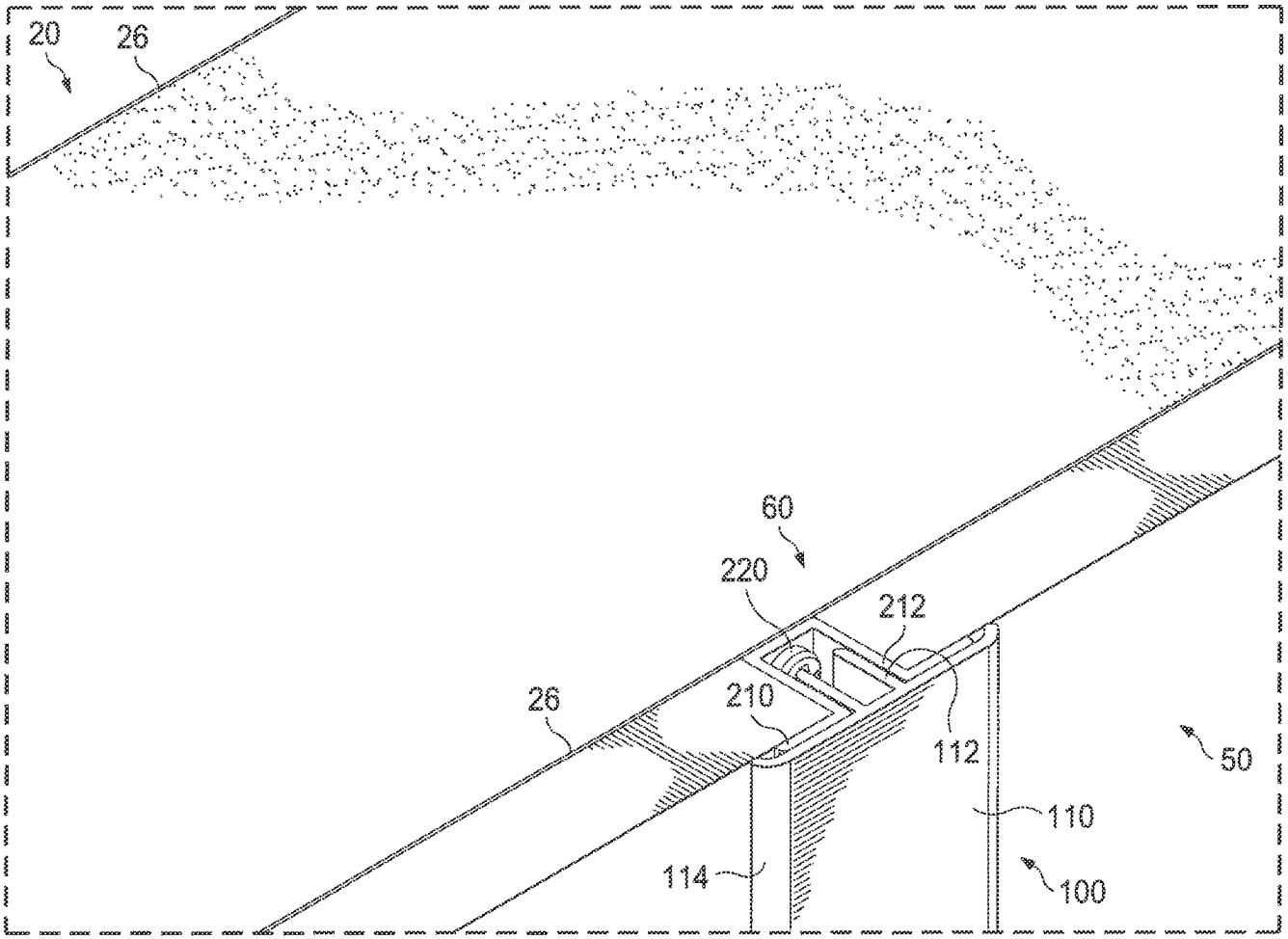
FIG. 2B shows the locking joint used to secure insulated veneer panels to the exterior surface of an insulated structural panel wall.

FIGS. 2A and 2B show an embodiment of the veneer system in accordance with the present invention. Veneer panels 50 are preferably overlayed the existing structural panels 20. Once in place, the veneer panels 50 are secured in place by locking joints 60. Additionally, veneer panels may be secured to structural panels 20 through the use of an appropriate adhesive, such as construction adhesive, epoxy, or other suitable gluing substance (not shown). Preferably, the locking joints 60 are off-set from the joints of structural members 22. This off-set protects the joints at structural members 22 from exposure to ambient air, thus reducing the likelihood of the formation of condensate at the joint. The veneer panels 50 may be of any desired thickness. Preferably, the locking joint 60 (as described below) is of substantially similar depth as the thickness of veneer panels 50.

Figure 3A:
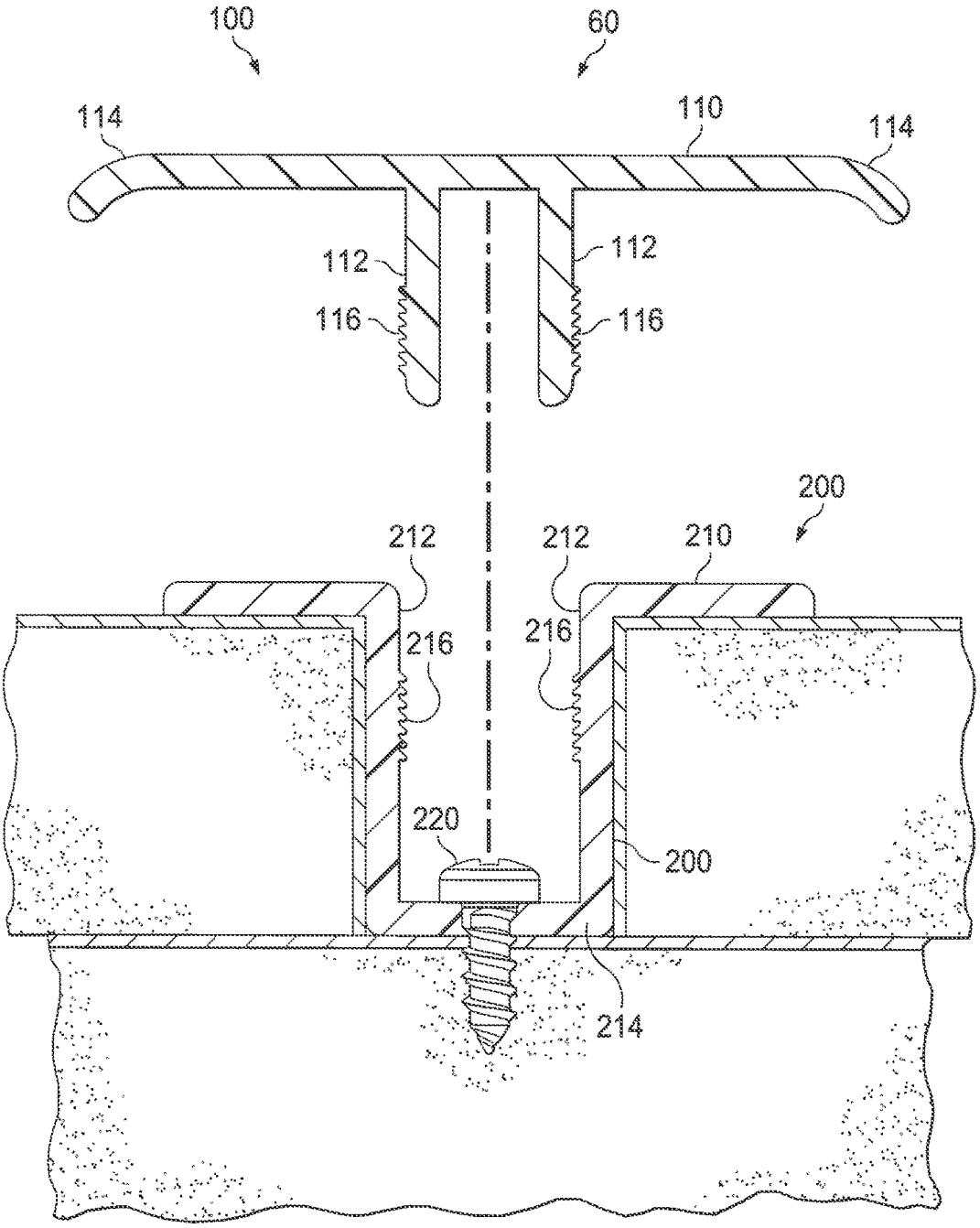
FIG. 3A shows the components of a locking joint to secure the insulated veneer panels.
Figure 3B:
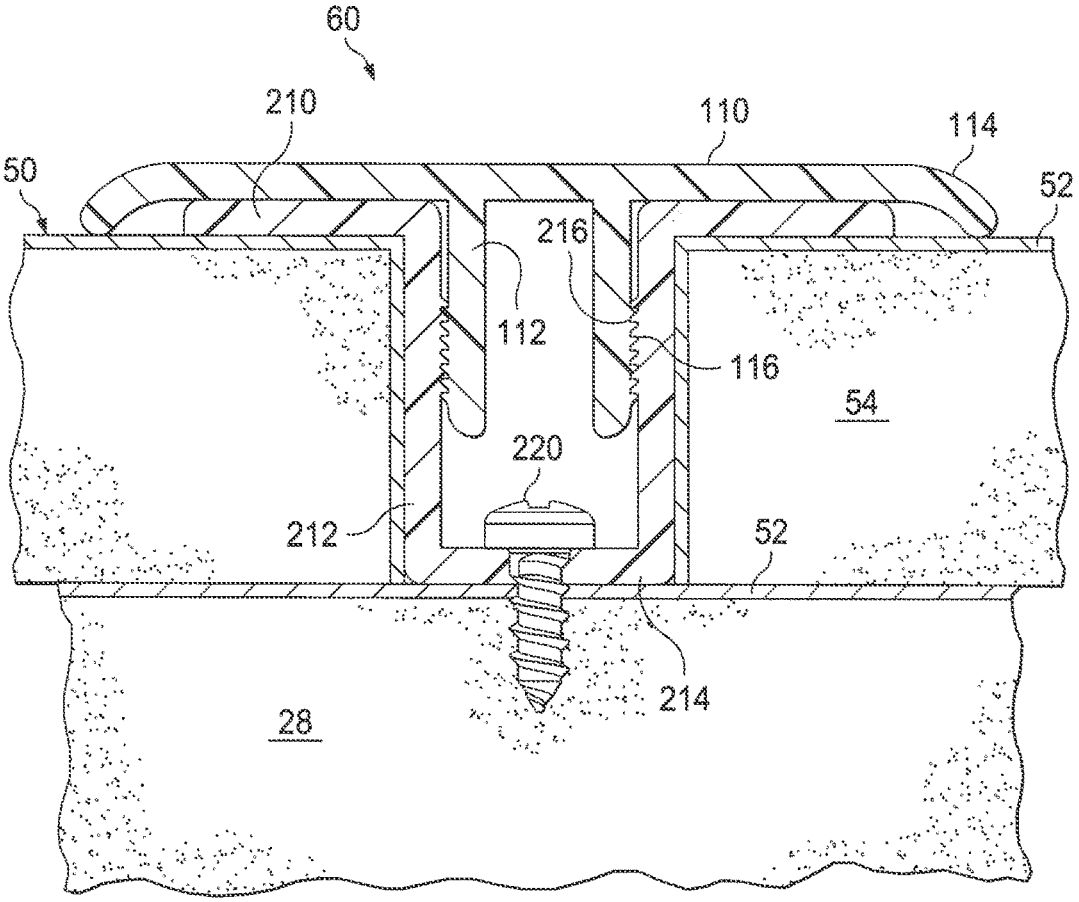
FIG. 3B shows the locking joint of FIG. 3A installed on an exterior surface of an insulated structural panel.

FIGS. 3A and 3B illustrate the locking joints in accordance with one embodiment of the invention. The locking joint 60 is comprised of a capped male insert 100 and a flanged female joint 200. The capped male insert 100 preferably includes a top plate 110, struts 112, and locking louvres 116. Additionally, the capped male insert includes seals 114 at the lateral edges of capped top plate 110. Seals 114 are preferably designed to fit against veneer panels 50 to reduce the amount of outside air that ingresses through the joint between veneer panels 50 and within the locking joint 60. The seals 114 also provide a barrier that reduces the likelihood that water or cleaning materials will enter the system, e.g., through high pressure spraying and washing. The seals 114 may be of the same material as the top plate 110 and struts 112, or may be of a softer material. In various embodiments, the seals may be constructed so that, when pressed against the face of veneer panels 50, the seals 114 deform to provide a tighter seal from the ingress of water and ambient air.

Flanged female joint 200 is constructed to fit between two veneer panels 50. In practice, it is preferable, though unnecessary, for the joint 200 to abut the edges of veneer panels 50, as shown in FIGS. 3A and 3B. In one embodiment, the base 214 of flange joint 200 is sufficiently wide to allow a fastener 220 to secure the flange joint 200 to a structural panel 50. In the embodiment shown, the fastener 220 is a screw, though other suitable fasteners will be apparent to one of ordinary skill in the art. In the embodiment shown, the flanged female joint is constructed as a single piece, including flanges 210, sidewalls 212, and base 214. Sidewalls 212 include integral louvres 216 designed to lockably engage louvres 116 of struts 112 of capped male insert 100, as shown in FIG. 3B. While locking louvres 116, 216 are shown, other suitable methods to join parts 100 and 200 may be used, such as other mechanical joints, adhesive, or fasteners, such as clips or screws.

The veneer panels 50 are positions such that they are adjacent to flanges 210 and sidewalls 212. When the female flanged joint 200 is fastened to a structural panel 50, with veneer panels 50 fully inserted behind the flange, the female flange joint 200 holds the veneer panels in place. Capped male insert 100 is then inserted into the flanged female joint 200 such that louvres 116 engaged louvres 216 to lock the capped male insert in place, and so that seals 114 are in contact with the surface of veneer panels 50 to prevent ambient air or liquid from ingress into the joint between the veneer panels 50 or structural panels 20.

Figure 4:
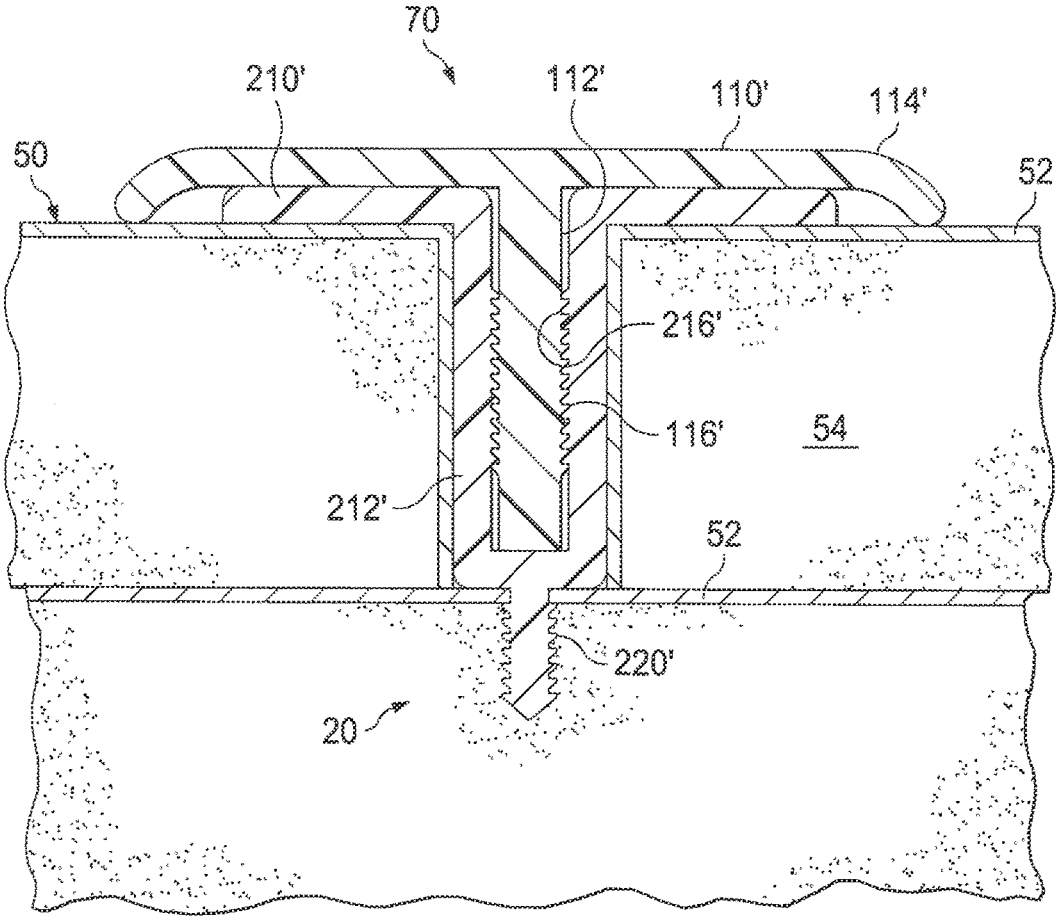
FIG. 4 shows an alternative embodiment of a locking joint.

FIG. 4 shows an alternative design for the locking joint. In this embodiment, locking joint 70 includes a prefabricated fastener 220' that protrudes beyond base 214' to fit into a pre-fabricated receptacle or pre-drilled hole in structural panel 20. The capped male insert 100' includes a top plate 110', a strut 112', and seals 114'. Additionally, the strut 112' includes locking louvres 116' on both sides of the strut 112'. The flanged female joint 200' includes a narrower space sized to accept the strut 112', and includes locking louvres 216' similar to the louvres 216 of FIGS. 3A and 3B. The design of FIG. 4 has the advantage of eliminating the air gap between struts 112 of FIGS. 3A and 3B.

Figure 5:
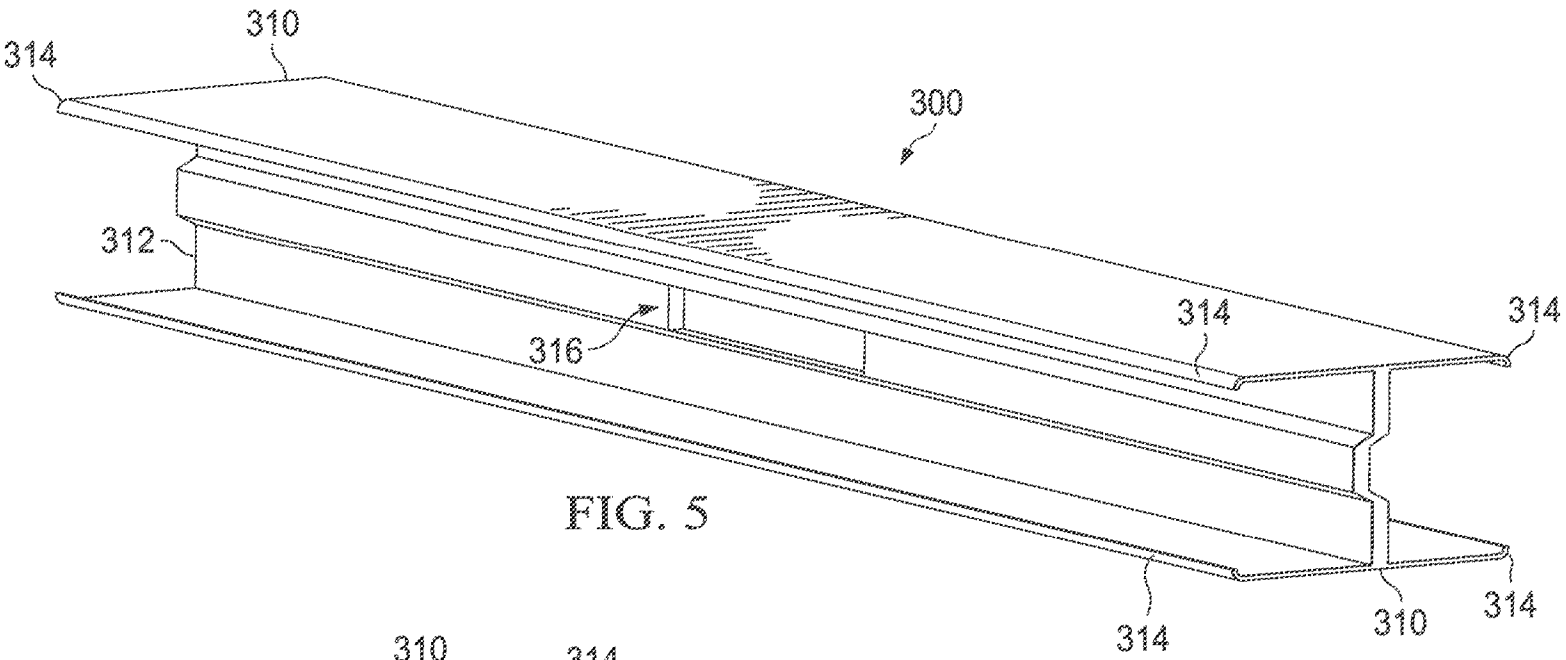
FIG. 5 shows an I-beam insulator seal in accordance with an embodiment of the present invention.
Figure 6:
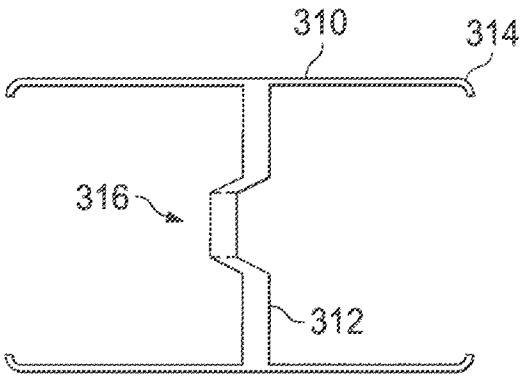
FIG. 6 shows a cross-sectional view of the I-beam insulator seal shown in FIG. 5.
Figure 7:
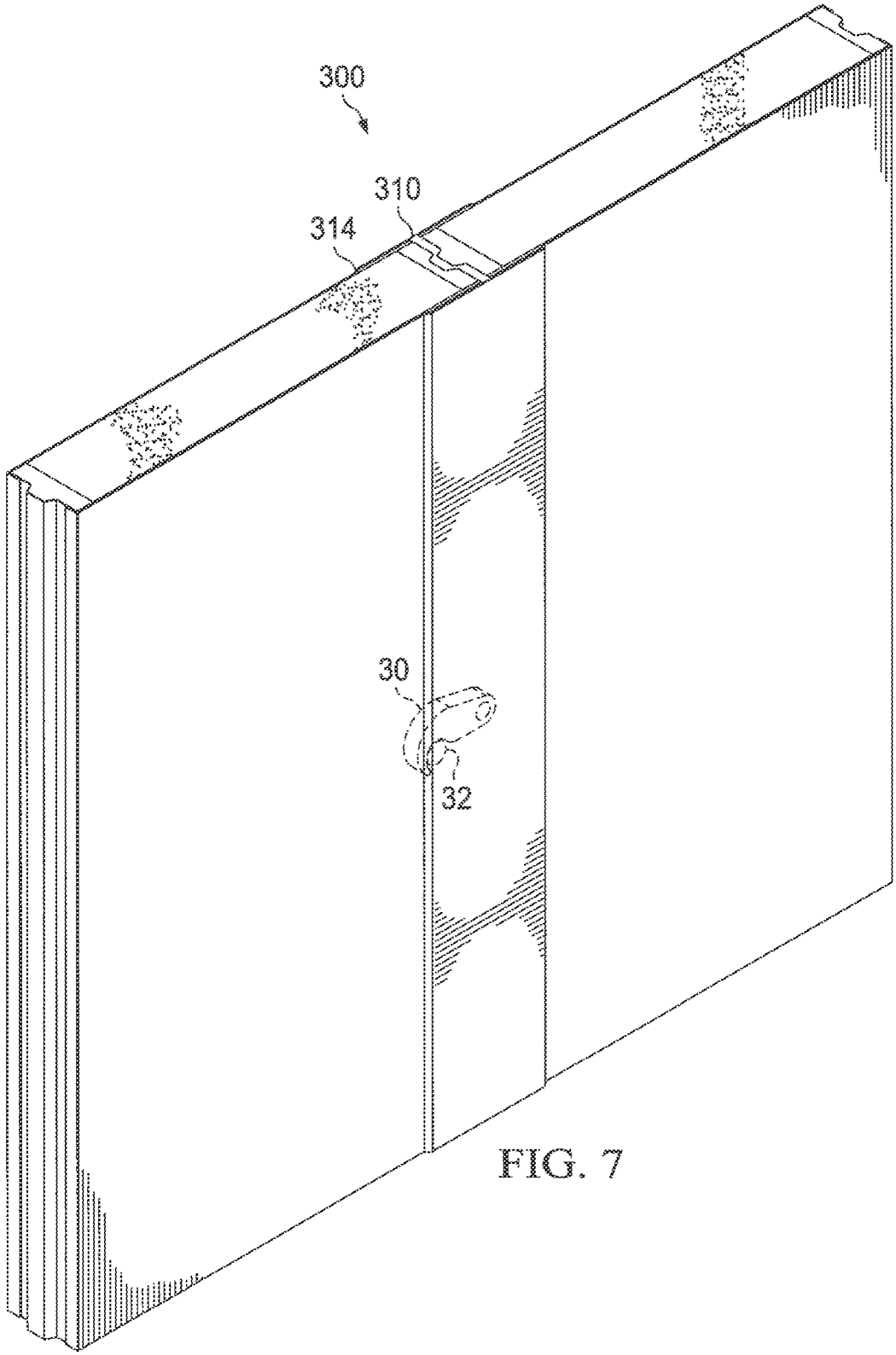
FIG. 7 shows an insulator seal installed between the joints of insulated structural panels.

In another embodiment of the present invention, a structural seal 300 is provided in FIGS. 5 through 7 for disposition between structural panels 20 to further reduce the loss of refrigeration from inside a refrigerated enclosure bounded by insulated structural panels 20 and to prevent condensation from contact from cooler air leaking through the joint with warmer ambient air on the outside of such structure.

The structural seal 300 of the present embodiment includes lateral members 310 that terminate on either end at sealing edges 314. A vertical member 312 is disposed between the lateral members 310. Preferably, the depth of the vertical member 310 is such that the interior portions of lateral members 310 are in contact with the sheathing 26 of insulated structural panels 20. Additionally, an opening or slit 316 is disposed within the vertical member 312 that corresponds to the location of the one or more latches 30 and latch-bars 32 that connect structural panels 20 to one another. During operation, the structural seal 300 is disposed between two insulated structural panels 20. When the a latch 30 is engaged with latch-bar 32 to bring the panel joints snug to one another, the panels are brought into sealing contact with vertical member 312 to reduce the likelihood of refrigerated air from within a refrigerated space bounded by structural panels 20 coming into contact with ambient air on the exterior, and to prevent unwanted condensation from forming between the structural panels 20. The lateral members 310 are preferable disposed directly against the sheathing 26 to extend the portion of the seal beyond the joint between structural members 22 to move the potential for leaked air further from the joint itself.

Any of the inventions disclosed herein, such as locking joints 100 and 100' or structural seal 300 may be constructed of any number of deformable polymers with varying degrees of stiffness. Examples of polymers that may be used in accordance with the present invention include, but are not limited to, PVC, plastics, nylons, or other suitable materials that are deformable when placed under a stress load.

While the present invention has been described in detail, it is not intended to be limited. Accordingly, various changes, variations, and substitutions may be made without departing with the scope of the invention as disclosed.

What is claimed is:

1. An insulated veneer panel system, comprising:

an insulated panel wall including a first insulated structural panel coupled to a second insulated structural panel, each of the first and second insulated structural panels including a structural member, sheathing, and a foam insulation disposed between the sheathing;

a veneer panel operatively coupled to the insulated panel wall, the veneer panel including an edge;

a locking joint operatively coupling the veneer panel to the insulated panel wall, the locking joint comprising a male portion and a female portion, the male portion including a strut and a top plate that terminates at at least a first edge distal from the strut with a sealing flange, the strut operable for insertion into the female portion;

the female portion including a flange, a first sidewall, and a base, the flange being operable to overlap the edge of the veneer panel, the sidewall being operable to abut the edge of the veneer panel, and the base is secured to a surface of the insulated panel wall, and wherein when the male portion is inserted into the female portion, the sealing flange of the male portion contacts a surface of the veneer panel.

2. The insulated veneer panel system of claim 1, wherein the strut of the male portion further comprises louvres operable to engage louvres disposed on an interior of the sidewall of the female portion when the male portion is inserted into the female portion.

3. The insulated veneer panel system of claim 1, wherein the male portion is operable to be secured to the female portion with adhesive when the male portion is inserted into the female portion.

4. The insulated veneer panel system of claim 1, further comprising a fastener operable to secure the base of the female portion to one of the insulated structural panels.

5. The insulated veneer panel system of claim 1, wherein the female portion further comprises an integrated fastener operable to engage the surface of one of the insulated structural panels.

6. The insulated veneer panel system of claim 1, wherein the locking joint is configured to engage one of the insulated structural panels at an approximate midpoint between the extreme lateral edges of the insulated structural panel.

7. The locking joint of claim 1, further comprising a second veneer panel, wherein the female portion of the locking joint includes a second sidewall separated from the sidewall by the base, wherein the second sidewall abuts an edge of the second veneer panel, and wherein the male portion includes a second sealing flange at a second edge opposite the sealing flange, and wherein the second sealing flange engages the second veneer panel when the male portion is inserted into the female portion, and wherein the second veneer panel is secured to the insulated panel wall.

8. The locking joint of claim 1, wherein the sealing flange of the male portion is deformable to seal against an exterior surface of the veneer panel.

9. A method for protecting an insulated structural panel wall with an insulated veneer panel, the method comprising:

covering a joint of an insulated structural panel wall, the insulated structural panel wall including first and second insulated structural panels coupled at the joint, each of the first and second insulated structural panels including a structural member, sheathing, and a foam insulation disposed between the sheathing;

securing a veneer panel to one of the first and second insulated structural panels to overlap the joint by coupling a locking joint to the veneer panel and to the one of the first and second insulated structural panels, wherein the locking joint comprises a male portion comprising a top plate that terminates at an edge of the top plate with a sealing flange and a strut, and a female portion sized to receive the strut of the male portion and wherein the female portion comprises a flange operable to overlap an edge of the veneer panel, a sidewall operable to abut the edge of the veneer panel, and a base operable to rest against an exterior surface of the one of the first and second insulated structural panels, and wherein the sealing flange of the male portion engages an exterior surface of the veneer panel when the male portion is inserted in the female portion.

10. The method of claim 9, comprising attaching the male portion to the female portion with an adhesive.

11. The method of claim 9, comprising coupling the male portion to the female portion by engaging locking louvres disposed on a surface of the strut of the male portion with corresponding locking louvres disposed on an interior surface of the sidewall of the female portion.

12. The method of claim 11, wherein the locking louvres of the male portion are integral to the strut.

13. The method of claim 12, wherein the locking louvres of the female portion are integral to the sidewall.

14. The method of claim 9, further comprising securing the base of the female portion to the exterior surface of the one of the first and second insulated structural panels with a fastener.

15. The method of claim 14, further comprising securing the veneer panel to the exterior surface of the one of the first and second insulated structural panels.

16. The method of claim 9, wherein securing the veneer panel to one of the first and second insulated panels includes laterally offsetting the locking joint relative to the joint between the first and second insulated structural panels such that the veneer panel overlays the joint of the insulated structural panel wall.

17. A locking joint assembly for securing insulated veneer panels to an insulated structural panel wall, comprising:

an insulated panel wall including a first insulated structural panel coupled to a second insulated structural panel at a joint, each of the first and second insulated structural panels including a structural member, sheathing, and a foam insulation disposed between the sheathing;

a first veneer panel operatively coupled to the insulated panel wall, the veneer panel including an interior edge;

a second veneer panel operatively coupled to the insulated panel wall, the second veneer panel including an interior edge facing the interior edge of the first veneer panel;

a locking joint operatively coupling the first veneer panel to the second veneer panel and secured to an exterior surface of the insulated panel wall, the locking joint offset from the joint of the insulated structural panel wall, wherein the locking joint includes a male portion and a female portion, the male portion including a strut sized for inserting into the female portion and a top plate that terminates at a longitudinal edge with a sealing flange, wherein the longitudinal edge being substantially parallel to the interior edge of the first veneer panel;

the female portion including a flange, a sidewall, and a base, the flange of the female portion being operable to overlap the interior edge of the first veneer panel, the sidewall being operable to abut the interior edge of the first veneer panel, and the base being operable to rest against the exterior surface of the insulated panel wall, wherein the male strut comprises louvres operable to securely engage louvres disposed on an interior surface of the sidewall of the female portion to secure the male portion to the female portion when the sealing flange rests against an exterior surface of the first veneer panel.

* * * * *